US011589654B2

(12) United States Patent
Sakaguchi et al.

(10) Patent No.: US 11,589,654 B2
(45) Date of Patent: Feb. 28, 2023

(54) LAST, METHOD FOR MANUFACTURING LAST, AND METHOD FOR MANUFACTURING FOOTWEAR UPPER

(71) Applicant: ASICS CORPORATION, Kobe (JP)

(72) Inventors: Masanori Sakaguchi, Kobe (JP); Yuya Kozuka, Kobe (JP); Shingo Takashima, Kobe (JP); Genki Hatano, Kobe (JP); Satoru Abe, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 17/235,316

(22) Filed: Apr. 20, 2021

(65) Prior Publication Data

US 2021/0330040 A1 Oct. 28, 2021

(30) Foreign Application Priority Data

Apr. 24, 2020 (JP) ..... JP2020-077797

(51) Int. Cl.
*A43D 3/14* (2006.01)
*A43B 23/02* (2006.01)

(52) U.S. Cl.
CPC ..... *A43D 3/14* (2013.01); *A43B 23/0205* (2013.01)

(58) Field of Classification Search
CPC ..... A43D 3/02; A43D 3/021; A43D 3/025; A43D 3/027; A43D 3/14; A43D 3/1441; A43D 3/145; A43D 3/1458
See application file for complete search history.

(56) References Cited

U.S. PATENT DOCUMENTS 1,691,054 A * 11/1928 Galterio ..... A43D 3/08 12/128 V
1,753,857 A * 4/1930 Galterio ..... A43D 3/1483 12/128 V
2007/0033750 A1* 2/2007 Cook ..... A43D 3/1458 12/133 R
2014/0082905 A1 3/2014 Wen
2016/0206049 A1 7/2016 Kallayil
(Continued)

FOREIGN PATENT DOCUMENTS

CN 108158134 A 6/2018
CN 109732913 A 5/2019
DE 234317 C 5/1911
(Continued)

OTHER PUBLICATIONS

Communication pursuant to Article 94(3) EPC issued by the European Patent Office dated Apr. 13, 2022, which corresponds to European Patent Application No. 21167892.5-1015 and is related to U.S. Appl. No. 17/235,316.
(Continued)

*Primary Examiner* — Ted Kavanaugh
(74) *Attorney, Agent, or Firm* — Studebaker & Brackett PC

(57) ABSTRACT

A last matching a user's foot can be provided through a simple configuration. A last for forming a footwear upper configuring an article of footwear comprises: a common portion invariable in shape and position, a movable portion invariable in shape and positionally variable with respect to the common portion, and a position adjustment mechanism that changes a position of the movable portion with respect to the common portion and fixes the movable portion in a predetermined position.

9 Claims, 11 Drawing Sheets

(56) References Cited

U.S. PATENT DOCUMENTS

| | | | | |
|---|---|---|---|---|
| 2018/0014609 | A1 | 1/2018 | Bruce et al. | |
| 2020/0113291 | A1* | 4/2020 | Smith | A43D 3/027 |

FOREIGN PATENT DOCUMENTS

| | | | |
|---|---|---|---|
| EP | 0 237 831 | A2 | 9/1987 |
| WO | 2016/146859 | A1 | 9/2016 |

OTHER PUBLICATIONS

The extended European search report issued by the European Patent Office dated Sep. 23, 2021, which corresponds to European Patent Application No. 21167892.5-1005 and is related to U.S. Appl. No. 17/235,316.

Communication pursuant to Article 94(3) EPC issued by the European Patent Office dated Oct. 17, 2022, which corresponds to European Patent Application No. 21167892.5-1015 and is related to U.S. Appl. No. 17/235,316.

* cited by examiner

LAST, METHOD FOR MANUFACTURING LAST, AND METHOD FOR MANUFACTURING FOOTWEAR UPPER

This nonprovisional application is based on Japanese Patent Application No. 2020-077797 filed on Apr. 24, 2020 with the Japan Patent Office, the entire contents of which are hereby incorporated by reference.

BACKGROUND OF THE INVENTION

Field of the Invention

The present disclosure relates to a last, a method for manufacturing a last, and a method for manufacturing a footwear upper.

Description of the Background Art

When an article of footwear is produced, a last (or a footwear model) for being covered with a cloth configuring a footwear upper is used in order to form the footwear upper into a predetermined shape.

U.S. Patent Application Publication No. 2018/0014609 discloses manufacturing an article of footwear in a portable housing. U.S. Patent Application Publication No. 2016/0206049 discloses a last preform reformable with a shape memory polymer. Chinese Patent No. 109732913 discloses forming a last by 3D printing.

SUMMARY OF THE INVENTION

When making a made-to-order article of footwear fitting a user's feet, a dedicated last reflecting the shape of the feet of each individual is produced. Manufacturing a user-dedicated last in a conventional manner employs dedicated large-size equipment and requires time and cost.

The present disclosure proposes a last having a simple configuration and matching a user's foot, a method for manufacturing the last, and a method for manufacturing a footwear upper using the last.

According to an aspect of the present disclosure, a last for forming a footwear upper configuring an article of footwear is proposed. The last comprises a common portion invariable in shape and position, a movable portion invariable in shape and positionally variable with respect to the common portion, and a position adjustment mechanism that changes a position of the movable portion with respect to the common portion and fixes the movable portion in a predetermined position.

According to an aspect of the present disclosure, a method for manufacturing a last for forming a footwear upper configuring an article of footwear is proposed. The present method for manufacturing a last comprises the following steps. A first step is a step of preparing a last including a common portion invariable in shape and position, a movable portion invariable in shape and positionally variable with respect to the common portion, and a position adjustment mechanism that changes a position of the movable portion with respect to the common portion and fixes the movable portion in a predetermined position. A second step is a step of adjusting the position adjustment mechanism to change the position of the movable portion with respect to the common portion.

According to an aspect of the present disclosure, a method for manufacturing a footwear upper is proposed. The method for manufacturing a footwear upper comprises the following steps. A first step is a step of covering the above-mentioned last with an unformed upper made of a fiber sheet including a heat-shrinkable yarn. A second step is a step of applying heat to form the unformed upper along the shape of the last to be a formed upper.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, embodiments will be described with reference to the drawings. In the following description, identical components are identically denoted. Their names and functions are also identical. Accordingly, such components will not be described repeatedly.

A last (or a footwear model) of an embodiment described below is mainly a last for a made-to-order article of footwear made to fit a user's foot. It should be noted, however, that the last of the embodiment is also applicable to a last for articles of footwear in mass production.

First Embodiment

Figure 1:
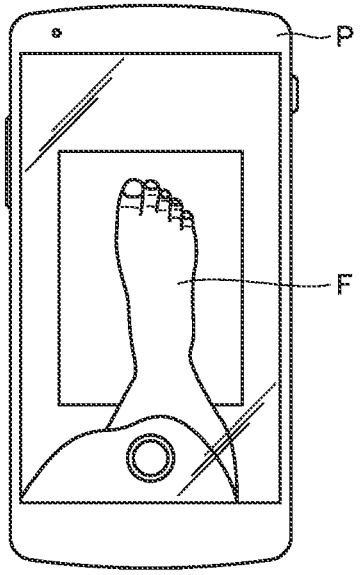
FIG. 1 is a diagram showing a user having his/her foot imaged to obtain a foot model.

FIG. 1 is a diagram showing a user having his/her foot F imaged to obtain a foot model FM. As shown in FIG. 1, a portable terminal capable of capturing an image, such as a smartphone P or a digital camera, is used to image the user's foot F to obtain image data of foot F. Image data of foot F can be obtained at a store visited by the user. The store may be a stationary store or a movable store using an automobile, a trailer, or the like. Alternatively, image data of foot F can be obtained at the user's home. The user per se may send his/her captured image data of foot F to a server of a footwear manufacturer.

Figure 2:
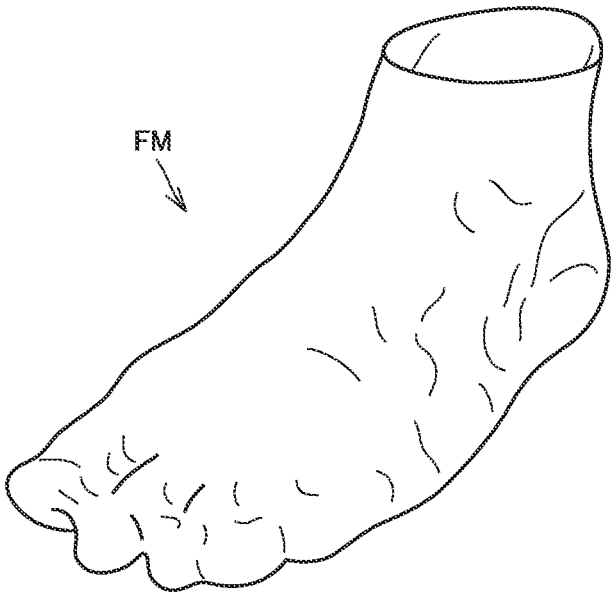
FIG. 2 is a perspective view of a foot model.

FIG. 2 is a perspective view of foot model FM. Foot model FM shown in FIG. 2 is a three-dimensional foot model generated from measured data of each part of foot F of the user obtained from image data of foot F. For example, when smartphone P is used to image the user's foot F, software previously installed in smartphone P can be used to generate foot model FM based on the image data. Alternatively, foot model FM can be generated by performing an operation on both the captured image data and data in a server used by a footwear manufacturer.

Foot model FM may be formed in the same shape as the user's foot F. Alternatively, for some reason in design or functionality, foot model FM may have a specific portion corrected from the shape of the user's foot F by a desired dimension.

Figure 3:
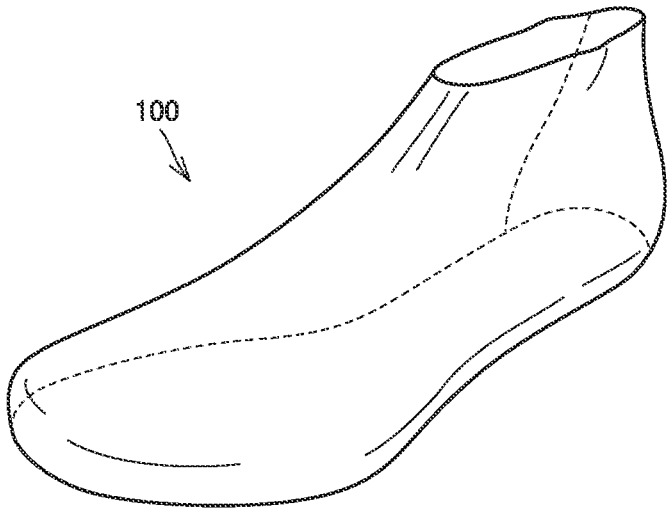
FIG. 3 is a perspective view of a last model.

FIG. 3 is a perspective view of a last model 100. Last model 100 shown in FIG. 3 is a model of a last created based on foot model FM shown in FIG. 2, and customized in accordance with the shape of the user's foot F. A made-to-order article of footwear dedicated to the user can be manufactured by forming a footwear upper using a last created in accordance with last model 100.

Figure 4:
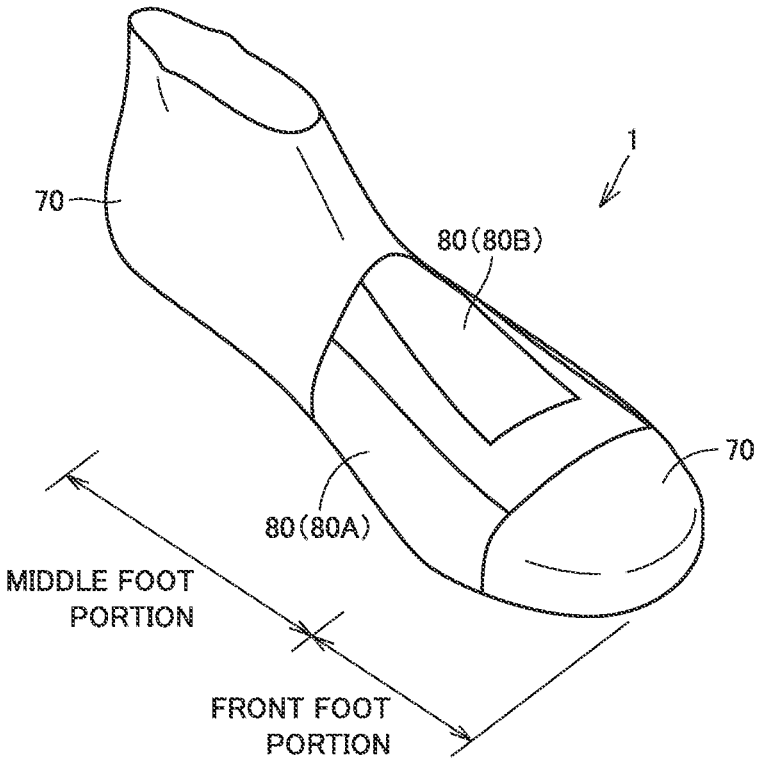
FIG. 4 is a perspective view of a last.

FIG. 4 is a perspective view of last 1. As shown in FIG. 4, last 1 has defined a front foot portion and a middle foot portion. For example, the front foot portion may be defined by a region corresponding to a region from the toes to MTP joint of a wearer of an article of footwear in the longitudinal direction of the article of footwear, and the middle foot portion may be defined by a region corresponding to a region from the MTP joint to cuneiform bone of the wearer in the same direction. Further, for example, when a foremost end of last 1 on the side of the toes is a position of 0% and a rearmost end of last 1 on the side of the heel is a position of 100%, the front foot portion may be defined by a range of last 1 from 0% to 30-35% in the longitudinal direction, and the middle foot portion may be defined by a range behind the front foot portion to 50-55%.

Last 1 shown in FIG. 4 comprises a common portion 70 invariable in shape and position at a toe portion and a portion extending from the middle foot portion to the heel portion corresponding a portion extending from the ankle of a foot to the arch of the foot. Last 1 also comprises a movable portion 80 that is invariable in shape and positionally variable. Last 1 comprises a movable portion 80A at a portion of the middle foot portion corresponding to the tip of the first toe of a foot and that of the fifth toe of the foot, and comprises a movable portion 80B at a portion of the middle foot portion on the side of the instep of the foot. Movable portion 80A is positionally variable widthwise. Movable portion 80B is positionally variable in level and angularly variable with respect to common portion 70.

Figure 5:
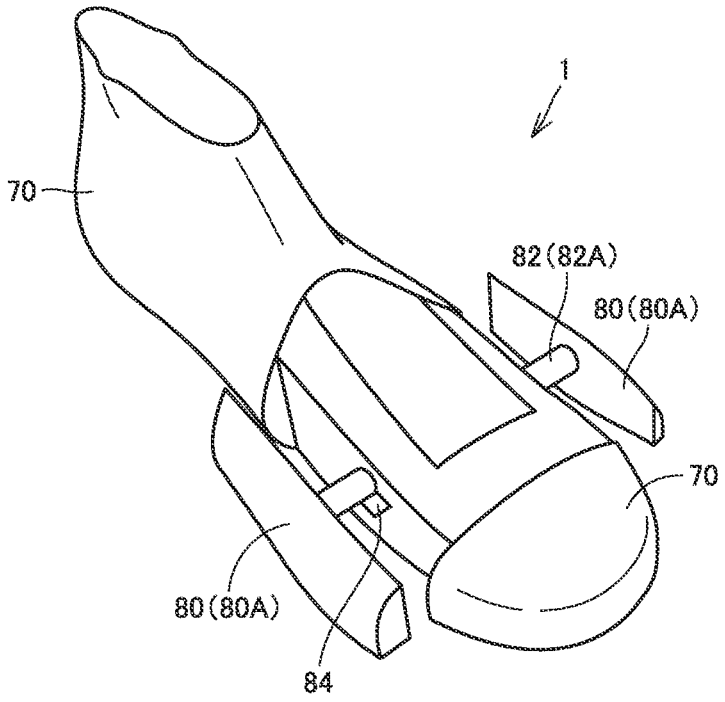
FIG. 5 is a perspective view of the last with a movable portion assuming a position changed widthwise.
Figure 6:
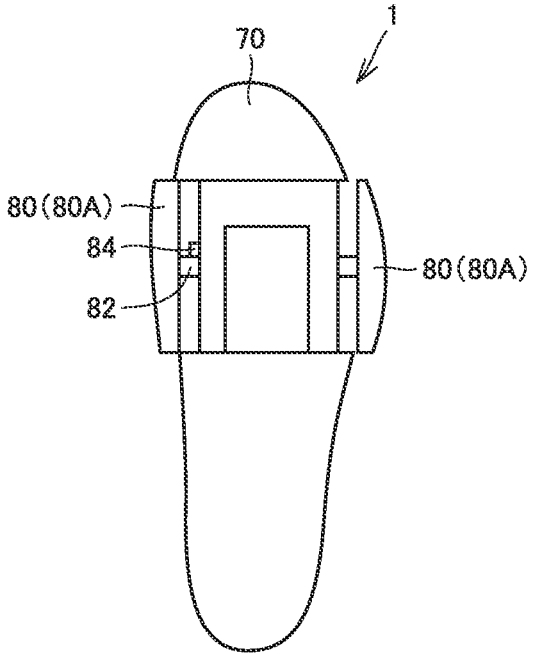
FIG. 6 is a plan view of the last with the movable portion assuming a position changed widthwise.

FIG. 5 is a perspective view of last 1 with movable portion 80A assuming a position changed widthwise. FIG. 6 is a plan view of last 1 with movable portion 80A assuming a position changed widthwise. As shown in FIGS. 5 and 6, last 1 comprises a position adjustment mechanism 82. A pair of right and left movable portions 80A is coupled by a position adjustment mechanism 82A. Position adjustment mechanism 82A changes a position of movable portion 80A with respect to common portion 70. After position adjustment mechanism 82A has changed the position of movable portion 80A, position adjustment mechanism 82A can fix movable portion 80A in a predetermined position.

Position adjustment mechanism 82A includes an engagement portion 84. Engagement portion 84 switches through a fitting structure, a screwing structure or the like between a first state in which movable portion 80A is fixed in the predetermined position and a second state in which movable portion 80A is movable. For example, position adjustment mechanism 82A may include a tube of a larger diameter and a tube of a smaller diameter accommodated in the tube of the larger diameter and capable of reciprocating with respect to the tube of the larger diameter, and engagement portion 84 may switch between a state in which engagement portion 84 is not engaged with at least one of the tube of the larger diameter and the tube of the smaller diameter to allow the tube of the smaller diameter to be movable with respect to the tube of the larger diameter and a state in which engagement portion 84 is engaged with both the tube of the larger diameter and the tube of the smaller diameter to make the tube of the smaller diameter immovable with respect to the tube of the larger diameter. In this case, engagement portion 84 may be implemented as a snap lock, a pin lock, a lock nut, or the like.

As a component configuring position adjustment mechanism 82A, an electrically driven mechanism component such as a stepping motor may be detachably accommodated in common portion 70. After movable portion 80A is positionally changed and fixed in the predetermined position, the mechanism component may be removed from common portion 70.

Movable portion 80A is positionally variable in the middle foot portion widthwise of last 1. When position adjustment mechanism 82A changes a position of movable portion 80A to increase a distance between the paired, right and left movable portions 80A, last 1 has a middle foot portion having an increased dimension in width. When position adjustment mechanism 82A changes a position of movable portion 80A to decrease a distance between the paired, right and left movable portions 80A, last 1 has a middle foot portion having a decreased dimension in width.

Figure 7:
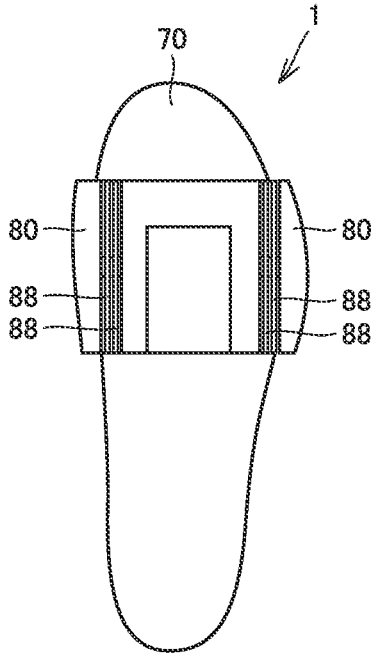
FIG. 7 is a plan view showing an incorporable last portion disposed in a gap between the movable portion and a common portion.

FIG. 7 is a plan view showing incorporable last portion 88 disposed in a gap between movable portion 80A and common portion 70. As shown in FIGS. 5 and 6, when the paired, right and left movable portions 80A are each moved away from common portion 70 to increase a distance between movable portions 80A, a gap is formed between each movable portion 80A and common portion 70. In the configuration shown in FIG. 7, incorporable last portion 88 in the form of a flat plate is disposed in the gap between each movable portion 80A and common portion 70. How many incorporable last portions 88 are disposed in the gap may be changed as appropriate in accordance with the size of the gap. In the example shown in FIG. 7, two incorporable last portions 88 are disposed between each of the right and left movable portions 80A and common portion 70.

Figure 8:
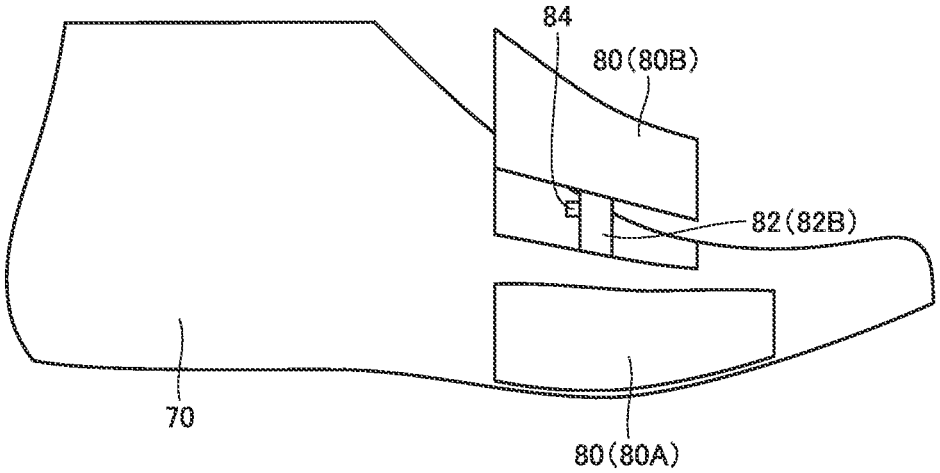
FIG. 8 is a side view of the last with a movable portion assuming a position changed in level.

FIG. 8 is a side view of last 1 with movable portion 80B assuming a position changed in level. As shown in FIG. 8, movable portion 80B is coupled with common portion 70 by a position adjustment mechanism 82B. Position adjustment mechanism 82B changes a position of movable portion 80B with respect to common portion 70. After position adjustment mechanism 82B has changed the position of movable portion 80B, position adjustment mechanism 82B can fix movable portion 80B in a predetermined position. Position adjustment mechanism 82B includes an engagement portion 84. Engagement portion 84 shown in FIG. 8 switches between a first state in which movable portion 80B is fixed and a second state in which movable portion 80B is movable, as engagement portion 84 shown in FIGS. 5 and 6 acts on movable portion 80A.

Movable portion 80B is positionally variable in the middle foot portion along the height of last 1. When position adjustment mechanism 82B moves movable portion 80B upward to increase a distance between movable portion 80B and common portion 70, last 1 has a middle foot portion having a dimension increased in height. When position adjustment mechanism 82B moves movable portion 80B downward to decrease a distance between movable portion 809 and common portion 70, last 1 has a middle foot portion having a dimension decreased in height.

Figure 9:
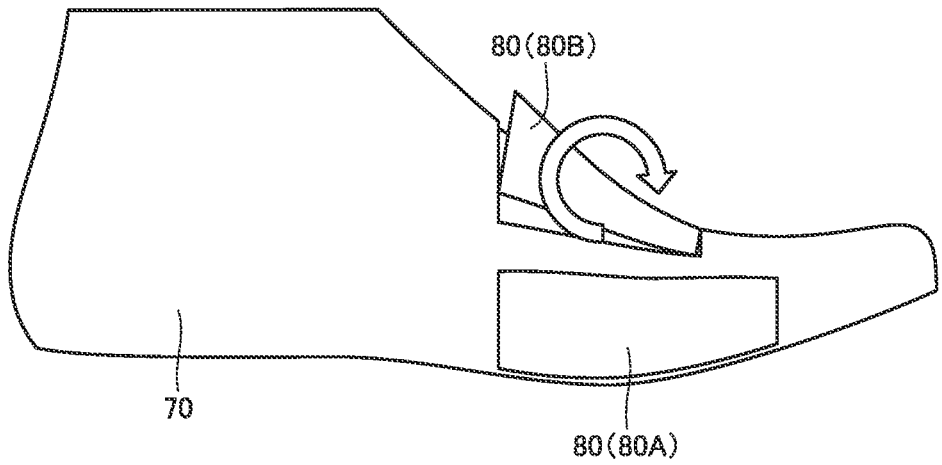
FIG. 9 is a side view of the last with the movable portion angularly changed with respect to the common portion.

FIG. 9 is a side view of last 1 with movable portion 80B angularly changed with respect to common portion 70. Movable portion 80B is coupled with common portion 70 by position adjustment mechanism 82B (not shown in FIG. 9). Movable portion 80B is angularly variable in the middle foot portion with respect to common portion 70.

Position adjustment mechanism 82B may have a transversely extending rotary shaft, and movable portion 80B may be supported by the rotary shaft and thus rotatable about the rotary shaft, as indicated in FIG. 9 by an arrow. Position adjustment mechanism 82B may include a gear allowing angular adjustment in multiple stages. Position adjustment mechanism 82B may include a universal joint. Movable portion 80B may be supported via the universal joint and configured to be capable of multiaxial rotation.

Figure 10:
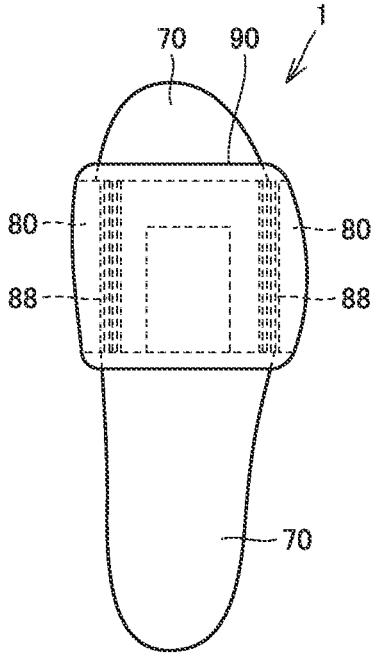
FIG. 10 is a plan view of the last covered with a cover.

FIG. 10 is a plan view of last 1 covered with cover 90. Last 1 may have at least a portion externally covered with cover 90. As shown in FIG. 10, when last 1 comprises movable portion 80, and a gap is formed between movable portion 80 and common portion 70 as movable portion 80 is positionally changed, cover 90 may have a shape to at least cover the gap formed in last 1. Last 1 may entirely, externally be covered with cover 90. Cover 90 may be in the form of a sheet or a plate.

Cover 90 may be a film that shrinks when it is heated, such as polystyrene film. In this case, last 1 can be covered with the film, which can in turn be heated and thus deformed to form cover 90 to cover a surface of last 1. In thermally deforming cover 90, air (warm air) may be sent from the inside of cover 90. This can suppress excessive inward shrinkage of cover 90 at a portion of connection of movable portion 80 and common portion 70 and can thus increase precision of forming a footwear upper.

Cover 90 may be metal foil represented by aluminum foil, and in this case, covering a surface of last 1 with metal enhances thermal conductivity, which is advantageous in heating and thus forming a footwear upper, as will be described hereinafter. Alternatively, cover 90 may be a sock.

Hereinafter, although there will be a description partially overlapping with the above description, a characteristic configuration as well as function and effect of the present embodiment will be listed below.

As shown in FIG. 4, last 1 comprises common portion 70 invariable in shape and position and movable portion 80 invariable in shape and positionally variable with respect to common portion 70. As shown in FIGS. 5, 6 and 8, last 1 comprises position adjustment mechanism 82. Position adjustment mechanism 82 changes a position of movable portion 80 with respect to common portion 70 and fixes movable portion 80 in a predetermined position.

Last 1 is divided, and movable portion 80 is used at a portion that is unlikely to vary in shape with different users and positionally varies with different users to make the portion positionally variable. Adjusting position adjustment mechanism 82 based on foot model FM of a target user to change a position of movable portion 80 with respect to common portion 70 and fix movable portion 80 in the changed position, allows last 1 corresponding to the shape of foot F of each user to be provided in a short time. Thus, last 1 matching the user's foot F can be provided through a simple configuration.

For a portion where it is unlikely that there is a difference between feet of users in shape and it is unnecessary to change last 1 in shape and position, common portion 70 that is invariable in shape and position can be used to allow last 1 to be further simplified in configuration, and thus reduce a period of time required to adjust last 1 in shape to match the user's foot in shape.

As shown in FIGS. 5 and 6, movable portion 80A may allow last 1 to have a middle foot portion positionally variable widthwise. Last 1 has a portion corresponding to a transverse arch of a foot that is implemented by a pair of right and left movable portions 80A to provide the portion with a widthwise dimension having an adjustment margin. This allows a portion of last 1 corresponding to the transverse arch of the foot to have a widthwise dimension matching the user's foot in shape.

As shown in FIG. 8, movable portion 80B may allow last 1 to have a middle foot portion positionally variable in level. Last 1 has a portion corresponding to an instep of a foot that is implemented by movable portions 80B to provide the portion with a dimension in height having an adjustment margin. This allows the portion of last 1 corresponding to the instep to have a dimension in height matching the user's foot in shape.

As shown in FIG. 9, movable portion 80B may allow last 1 to have a middle foot portion angularly variable with respect to common portion 70. Last 1 having a portion corresponding to an instep of a foot that is further, angularly adjustable can have the portion to match the user's foot in shape with better precision.

As shown in FIGS. 5, 6 and 8, position adjustment mechanism 82 may include engagement portion 84. Engagement portion 84 switches between a first state in which movable portion 80 is fixed in a predetermined position and a second state in which movable portion 80 is movable. Engagement portion 84 can be set in the second state to move movable portion 80 to a position to match the user's foot in shape, and in that position, engagement portion 84 can be set in the first state to fix movable portion 80. When engagement portion 84 is set in the first state, movable portion 80A is immovable in either direction widthwise and movable portion 80B is immovable vertically in either direction. This ensures that last 1 is formed into a target shape matching the user's foot F.

As shown in FIG. 7, last 1 may further comprise incorporable last portion 88. Incorporable last portion 88 is disposed in a gap formed between movable portion 80A and common portion 70 after movable portion 80A is positionally changed with respect to common portion 70. After movable portion 80 is positionally changed, common portion 70 and movable portion 80 may have their respective external surfaces with a gap or step resulting from a difference in position and shape, and incorporable last portion 88 can be disposed in such a gap or step to smoothly connect the external surfaces of common portion 70 and movable portion 80.

Figure 11:
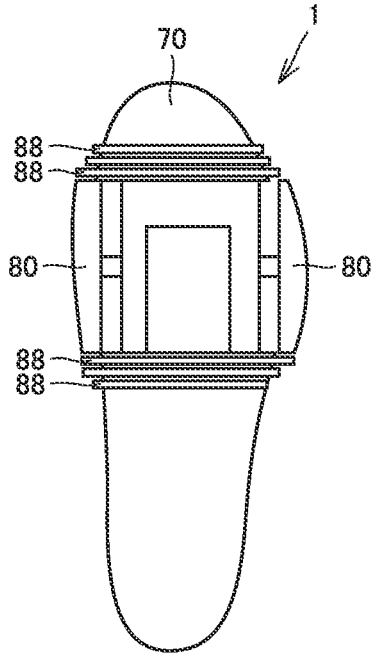
FIG. 11 is a plan view of a last comprising an incorporable last portion extending transversely.

While incorporable last portion 88 shown in FIG. 7 is disposed to extend in the longitudinal direction, incorporable last portion 88 may be provided to extend transversely depending on the shape of the gap or step. FIG. 1.1 is a plan view of last 1 comprising incorporable last portion 88 extending transversely. As shown in FIG. 11, incorporable last portion 88 provided on a step formed between movable portion 80 protruding from common portion 70 widthwise and common portion 70 can reduce the step and connect a widthwise dimension of last 1 smoothly.

As shown in FIG. 10, last 1 may further comprise cover 90 in the form of a sheet or a plate that externally covers at least a portion of last 1 or a gap formed in last 1. Covering last 1 with cover 90 can eliminate a gap and a step formed between common portion 70 and movable portion 80 when forming a footwear upper using last 1 of the embodiment, and suppress an effect of the gap and step on the formed footwear upper in shape. This more reliably allows a footwear upper to be formed to have a predetermined shape.

As shown in FIGS. 1 to 3, foot model FM is generated from data of a captured image of a user's foot F, and last model 100 is generated based on foot model FM. By moving movable portion 80 to an appropriate position based on last model 100, as shown in FIGS. 5 and 8 to 9, last 1 having a final shape corresponding to foot model FM of the user is formed. Last model 100 configures appropriate-position data indicating an appropriate position of movable portion 80 with respect to common portion 70. This ensures that last 1 is formed to have a shape corresponding to that of foot F of the user.

Second Embodiment

Figure 12:
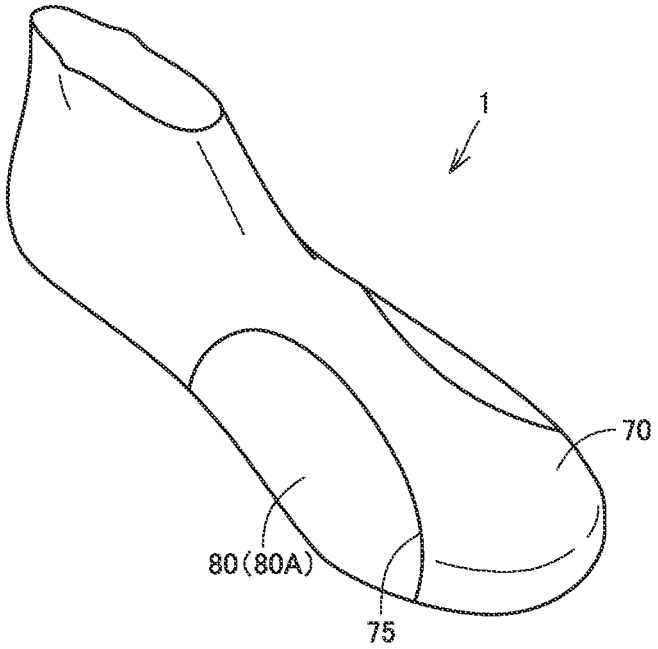
FIG. 12 is a perspective view of a last according to a second embodiment.

FIG. 12 is a perspective view of last 1 of a second embodiment. In the first embodiment, a line along a boundary portion of common portion 70 and movable portion 80A, that is, a line along a gap formed between common portion 70 and movable portion 80A is a straight line, as shown in FIG. 4. As shown in FIG. 12, a line along a boundary portion 75 of common portion 70 and movable portion 80 may be a curved line. Further, the line along boundary portion 75 of common portion 70 and movable portion 80 corresponds for example to a line extending along the first and fifth metatarsal bones of a wearer of an article of footwear. The line along boundary portion 75 may extend along any metatarsal bone. When a line along boundary portion 75 is referred to as extending along a metatarsal bone the line along boundary portion 75 has only to have in at least a portion in the longitudinal direction a portion generally parallel to the metatarsal bone.

Thus defining common portion 70 and movable portion 80A in shape allows last 1 to be formed to match the user's foot in shape with better precision.

Third Embodiment

Figure 13:
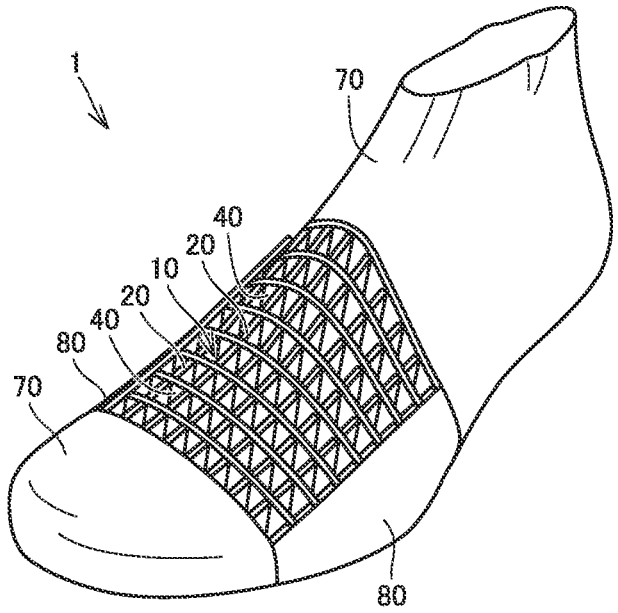
FIG. 13 is a perspective view of a last according to a third embodiment.

FIG. 13 is a perspective view of last 1 of a third embodiment. In the first embodiment, an example has been described in which a portion of the middle foot portion that corresponds to the instep of a foot is movable portion 80B. Instead of this example, as shown in FIG. 13, the portion corresponding to the instep of the foot may be an incorporable last portion 10. Incorporable last portion 10 is incorporated into a groove formed in common portion 70 or a space formed between common portion 70 and movable portion 80 to configure a portion of last 1.

Incorporable last portion 10 shown in FIG. 13 is formed by assembling a plurality of foot length forming members 20 and a plurality of foot width forming members 40 together. Foot length forming member 20 is in the form of a plate extending in the longitudinal direction. Foot length forming member 20 defines a shape of last 1 at least in the longitudinal direction. Foot width forming member 40 is in the form of a plate extending in the transverse direction. Foot width forming member 40 defines at least a shape of last 1 in the transverse direction, and is assembled to foot length forming member 20.

Foot length forming member 20 and foot width forming member 40 can be formed by cutting them out of a sheet-shaped base member. Foot length forming member 20 and foot width forming member 40 may be made of paper such as cardboard, or may be made of resin such as thermoplastic resin. Foot length forming member 20 and foot width forming member 40 may have engagement grooves for incorporating the members into each other.

A portion of the middle foot portion corresponding to the instep is a portion having a largest difference in shape among feet of users. Forming a groove or a space at this portion and using incorporable last portion 10 therein allow last 1 to be formed to match the user's foot in shape with better precision. Incorporable last portion 10 personalized for and thus dedicated to each user may be fabricated. Alternatively, a plurality of incorporable last portions 10 different in shape may previously be prepared, and incorporable last portion 10 corresponding to foot model FM of the user and having a shape closest thereto may be selected and used.

Fourth Embodiment

Figure 14:
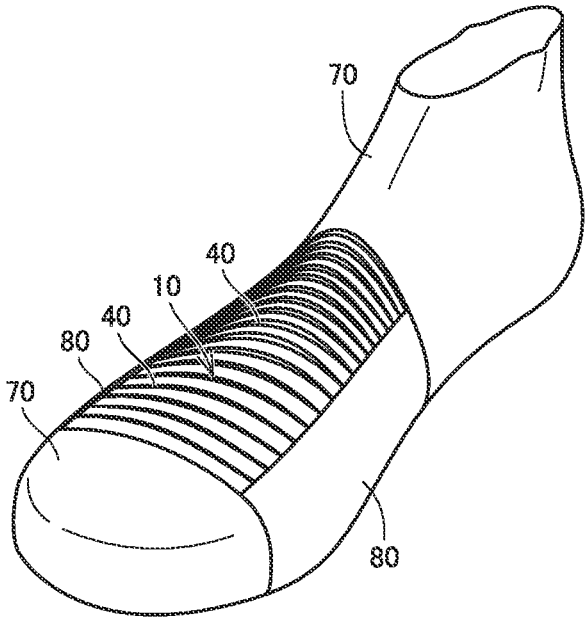
FIG. 14 is a perspective view of a last according to a fourth embodiment.

FIG. 14 is a perspective view of last 1 according to a fourth embodiment. In the third embodiment has been described incorporable last portion 10 having foot length forming member 20 and foot width forming member 40 both exposed at an external surface of last 1. As shown in FIG. 14, incorporable last portion 10 may be formed such that foot width forming member 40 is alone exposed at an external surface of last 1. Foot width forming member 40 shown in FIG. 14 is formed as a transversely extending plate-shaped member. Incorporable last portion 10 has a plurality of foot width forming members 40. Foot width forming member 40 may be cut out of a sheet-shaped base member, based on foot model FM of a target user.

Figure 15:
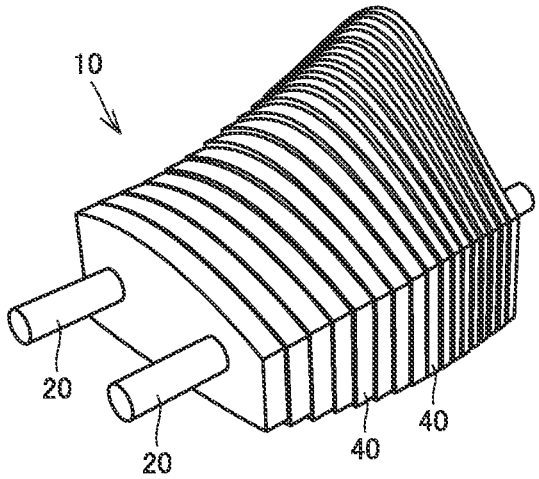
FIG. 15 is a perspective view of an incorporable last portion according to the fourth embodiment.
Figure 16:
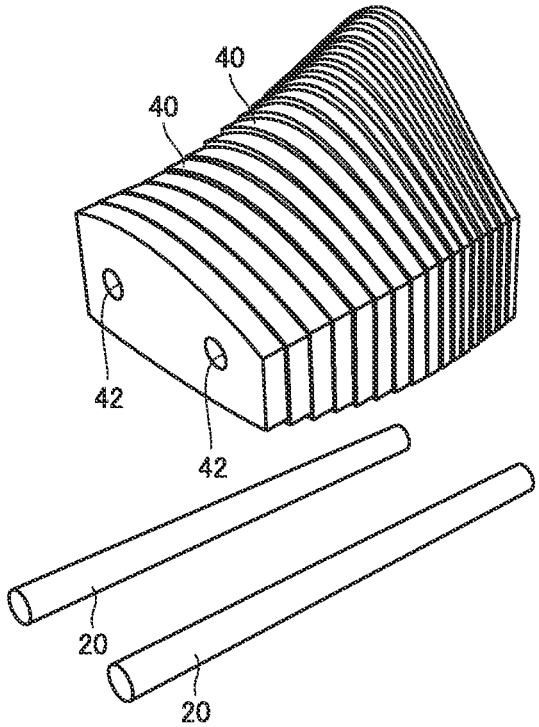
FIG. 16 is an exploded perspective view of the incorporable last portion of the fourth embodiment.

FIG. 15 is a perspective view of incorporable last portion 10 according to the fourth embodiment. FIG. 16 is an exploded perspective view of incorporable last portion 10 of the fourth embodiment. As shown in FIGS. 15 and 16, foot length forming member 20 is in the form of a rod. Foot length forming member 20 is formed as a rod-shaped member extending in the longitudinal direction. Foot width forming member 40 has two throughholes 42 allowing rod-shaped foot length forming member 20 to pass therethrough.

By passing rod-shaped foot length forming member 20 through throughhole 42, foot width forming member 40 is assembled to foot length forming member 20. Thus, incorporable last portion 10 can be simplified in configuration, stabilized in shape, and assembled faster. The number of rod-shaped foot length forming members 20 and that of throughholes 42 of foot width forming member 40 are not limited to two such members and two throughholes, as illustrated, and one or more such members and one or more throughholes may be provided. Throughhole 42 may be replaced with a groove formed in foot width forming member 40 and allowing rod-shaped foot length forming member 20 to be fitted therein.

While a plurality of foot width forming members 40 aligned in the longitudinal direction may be plates equal in thickness, the plurality of foot width forming members 40 may be plates different in thickness, as shown in FIGS. 14 to 16. Specifically, foot width forming members 40 may be different in thickness such that foot width forming member 40 close to the toes is a plate large in thickness and foot width forming member 40 close to the heel is a plate small in thickness. A foot has an instep varying in shape to have a curvature gradually increasing in a direction from the toes toward the heel. Reducing foot width forming member 40 in thickness on a side closer to the heel where a foot has an instep significantly varying in shape allows last 1 to be finely adjusted in dimension in height and width. This allows last 1 to further better reproduce a user's foot in shape.

Preventing foot width forming member 40 from being excessively reduced in thickness on a side closer to the toes where a foot does not have an instep significantly varying in shape can reduce the number of parts configuring incorporable last portion 10. This allows last 1 to be manufactured faster.

While a plurality of foot width forming members 40 may be aligned in the longitudinal direction without a gap, as shown in FIGS. 14 to 16, a gap may be formed between foot width forming members 40 adjacent to each other in the longitudinal direction. In this case, disposing a spacer between adjacent foot width forming members 40 can determine a spacing between adjacent foot width forming members 40. The spacer may be provided as a member discrete from foot length forming member 20 and foot width forming member 40, or may be integrated with foot width forming member 40.

Figure 17:
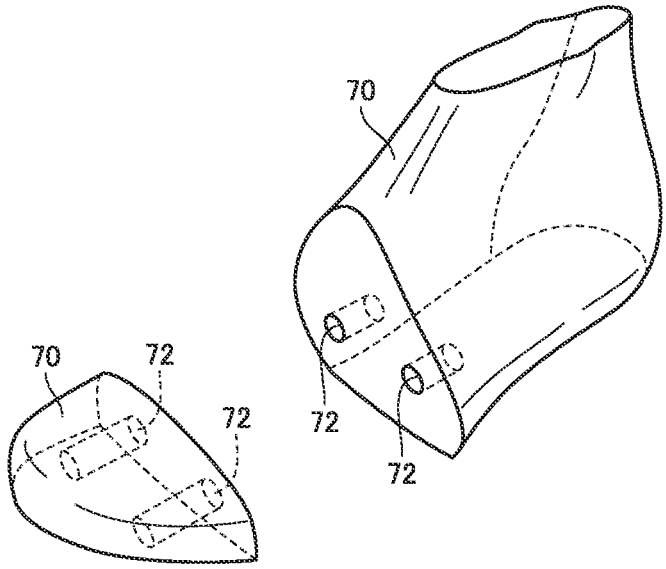
FIG. 17 is a perspective view of a common portion according to the fourth embodiment.

FIG. 17 is a perspective view of common portion 70 according to the fourth embodiment. As shown in FIG. 17, common portion 70 has a receiving hole 72 formed therein. Common portion 70 configuring a toe portion of last 1 has two bottomed receiving holes 72, and common portion 70 configuring a heel portion of last 1 has two bottomed receiving holes 72. The number of receiving holes 72 formed in common portion 70 is equal to that of rod-shaped foot length forming members 20 shown in FIGS. 15 and 16. Receiving hole 72 extends in the longitudinal direction. Receiving holes 72 are formed in the same shape on the same straight line extending in the longitudinal direction. Receiving hole 72 receives an end portion of foot length forming member 20.

Since common portion 70 has receiving hole 72 for receiving rod-shaped foot length forming member 20 therein and supporting it in a predetermined position, foot length forming member 20 can be supported in common portion 70 in an appropriate position. Thus, incorporable last portion 10 in which plate-shaped foot width forming member 40 is assembled to rod-shaped foot length forming member 20 can be fixed in an appropriate position with respect to common portion 70.

While incorporable last portion 10 is composed of plate-shaped foot length forming member 20 and plate-shaped foot width forming member 40 combined together, as described in the third embodiment, and rod-shaped foot length forming member 20 and plate-shaped foot width forming member 40 assembled thereto, as described in the fourth embodiment, incorporable last portion 10 may be a block-shaped member obtained by solidifying resin or pulp. Block-shaped incorporable last portion 10 may be solid or hollow. Incorporable last portion 10 may be a solid molded article manufactured using a 3D printer.

Fifth Embodiment

Figure 18:
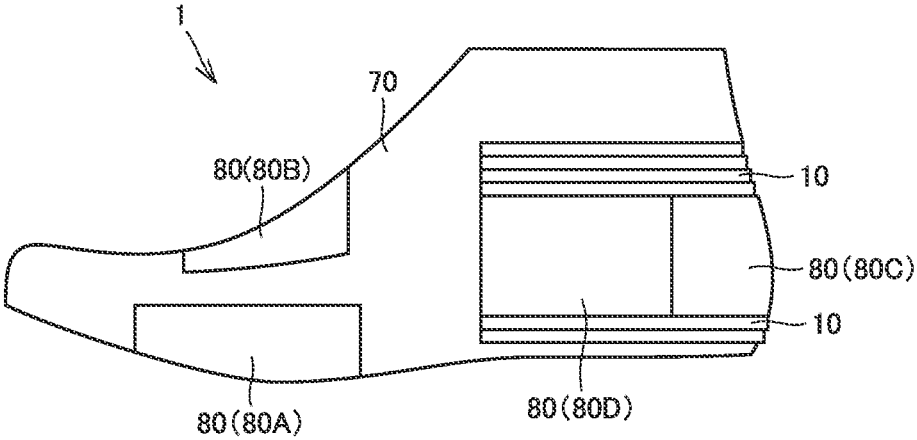
FIG. 18 is a side view of a last according to a fifth embodiment.
Figure 19:
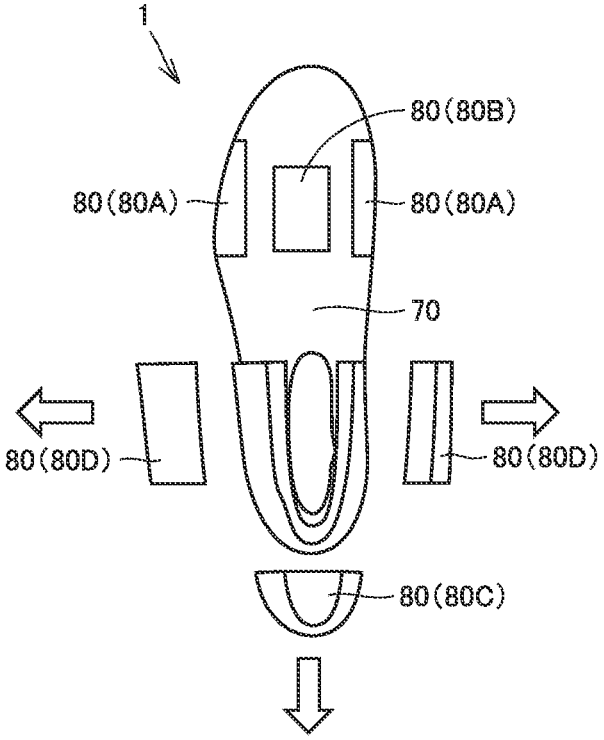
FIG. 19 is a plan view schematically showing positionally changing a movable portion for a heel portion.
Figure 20:
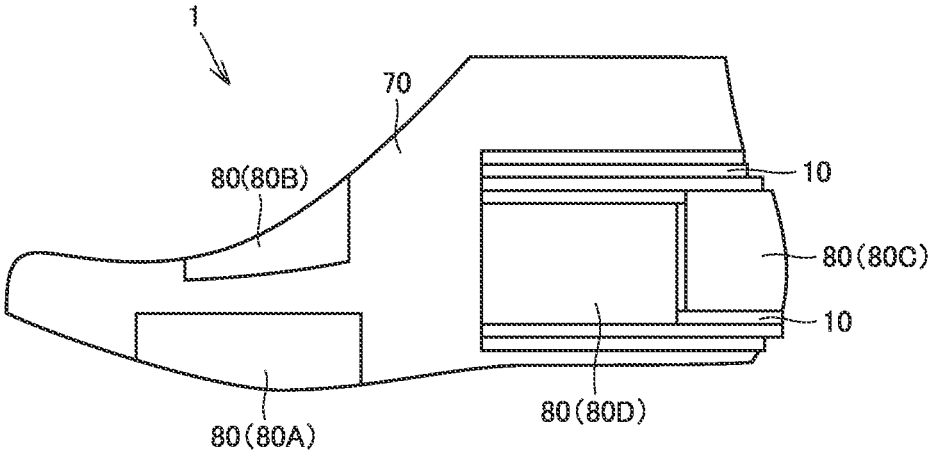
FIG. 20 is a side view of a last with the movable portion for the heel portion positionally changed.

In the above embodiments is described an example of last 1 in which a portion extending from a middle foot portion to a heel portion is formed as common portion 70. Instead of this example, last 1 may also comprise movable portion 80 in the heel portion. FIG. 18 is a side view of last 1 of the fifth embodiment. FIG. 19 is a plan view schematically showing positionally changing movable portion 80 for the heel portion. FIG. 20 is a side view of the last with movable portion 80 for the heel portion positionally changed.

As shown in FIGS. 18 to 20, movable portion 80 for the heel portion may include a movable portion 80C that is provided at a rearmost portion of the heel and can reciprocate longitudinally of last 1 and thus change a longitudinal dimension of last 1. Movable portion 80 for the heel portion may include a movable portion 80D that is provided to last 1 at a portion of a rear foot portion located on a side/sides corresponding to the lateral ankle and/or the medial ankle and is movable widthwise of last 1 to change a widthwise dimension of the rear foot portion of last 1. Movable portion 80 for the heel portion may be movable in level in addition to longitudinally and widthwise. The movable portion for the heel portion may be angularly variable with respect to common portion 70. A cavity for permitting movement of movable portion 80 is formed above and below the movable portion for the heel portion, and incorporable last portion 10 formed to match a user's foot F in shape is introduced in the cavity.

In last 1 shown in FIG. 20, movable portion 80C is moved rearward in the longitudinal direction and further moved upward, and thus fixed in that rearward and upward position. Movable portion 80D is moved widthwise and fixed in a position where a distance between paired, right and left movable portions 80D is increased. Thus, movable portions 80A and 80B positionally variable in last 1 at the middle foot portion, and in addition, movable portions 80C and 80D positionally variable in last 1 at the heel portion are comprised to allow last 1 to be formed to match a user's foot in shape with better precision or formed into a desired shape.

Sixth Embodiment

Figure 21:
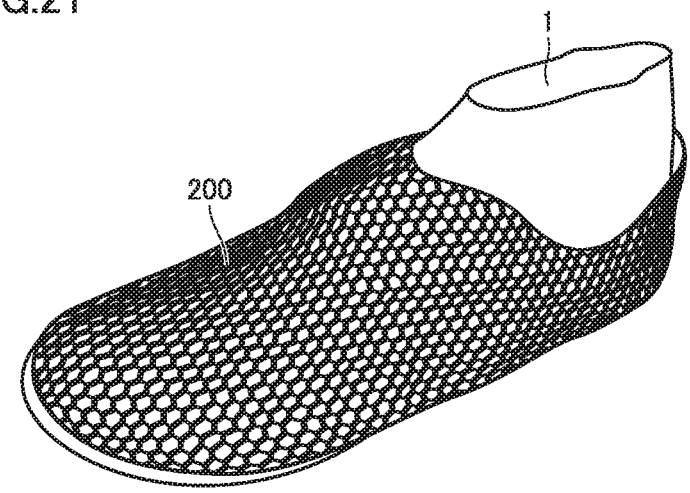
FIG. 21 is a perspective view showing a last covered with an unformed upper.

In a sixth embodiment will be described a method for manufacturing a footwear upper using last 1 described in the above embodiments. FIG. 21 is a perspective view showing last 1 covered with an unformed upper 200. For example, a material made of a fiber sheet including a heat-shrinkable yarn (i.e., unformed upper 200) is prepared for a footwear upper. Last 1 is covered with unformed upper 200 larger than the external shape of last 1 to obtain the configuration shown in FIG. 21.

Figure 22:
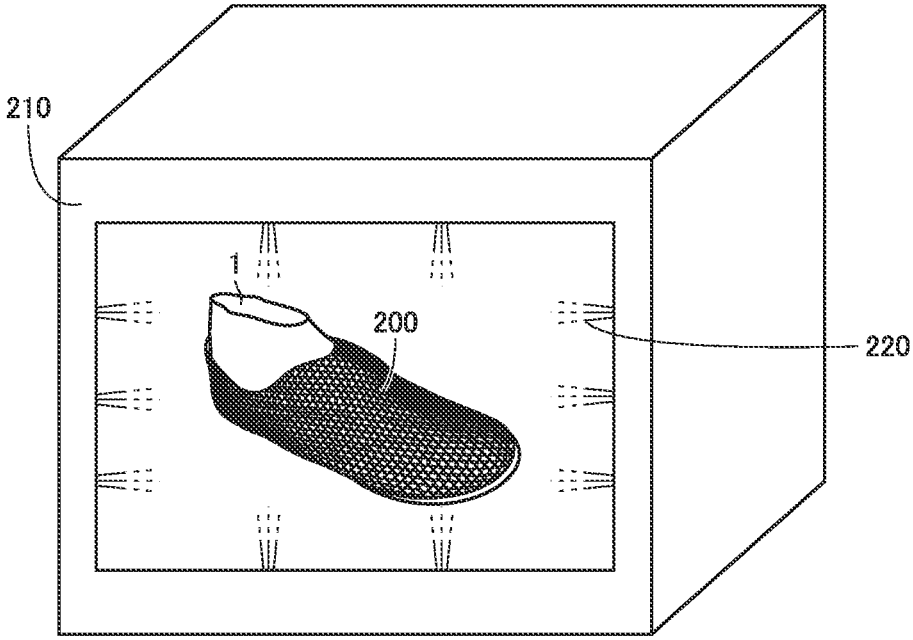
FIG. 22 is a schematic view of a process of heating the unformed upper covering the last.

FIG. 22 is a schematic view of a process of heating unformed upper 200 covering last 1. As shown in FIG. 22, last 1 covered with unformed upper 200 is accommodated in a heating box 210. In this state, hot steam 220 is discharged from an internal surface of heating box 210. Thus, unformed upper 200 is heated with steam. By this heating with steam, unformed upper 200 is entirely, uniformly heated. The heating can cause the heat-shrinkable yarn to shrink to allow unformed upper 200 to be a formed upper along the shape of last 1.

Through such a manufacturing process, a footwear upper matching a user's foot F in shape and thus dedicated to the user can be manufactured without using large-scale facilities.

Heating box 210 may be a steam oven. While unformed upper 200 is heated with steam, unformed upper 200 may be heated with hot air, warm water or the like. Unformed upper 200 may be heated partially rather than entirely. The thus formed upper is attached to a separately formed footwear sole through adhesion, thermal fusion bonding, or the like.

While each step is performed or after the whole process is completed, a shoe tongue is formed, a footwear opening is processed, eyelets are attached for passing a shoelace therethrough, an ornament and a tag are attached, a logo is printed, an insole is attached and the like to manufacture an article of footwear.

The method for manufacturing the footwear upper is not limited to thermal shrinkage of a fiber sheet including a heat-shrinkable yarn, as described above, and a variety of methods may be employed, for example, knitting a material around last 1 directly, additive manufacturing with a 3D printer, or the like. It is also possible to use last 1 of the embodiments in a conventionally known process of forming a footwear upper in a factory.

SUMMARY OF DISCLOSURE IN EMBODIMENTS OR THE LIKE

The characteristic configurations disclosed in the above-described embodiments and modifications thereof will be summarized as follows.

A last according to an embodiment of the present disclosure is directed to forming a footwear upper configuring an article of footwear. The last comprises a common portion invariable in shape and position, a movable portion invariable in shape and positionally variable with respect to the common portion, and a position adjustment mechanism that changes a position of the movable portion with respect to the common portion and fixes the movable portion in a predetermined position.

In the last according to an embodiment of the present disclosure, the movable portion may allow the last to have a middle foot portion positionally variable widthwise of an article of footwear.

In the last according to an embodiment of the present disclosure, the movable portion may allow the last to have a middle foot portion positionally variable in level.

In the last according to an embodiment of the present disclosure, the movable portion may allow the last to have a middle foot portion angularly variable with respect to the common portion.

In the last according to an embodiment of the present disclosure, the position adjustment mechanism may have an engagement portion that switches between a first state in which the movable portion is fixed in a predetermined position and a second state in which the movable portion is movable.

In the last according to an embodiment of the present disclosure, a line along a boundary portion of the common portion and the movable portion may be a straight or curved line corresponding to a line extending along a metatarsal bone of a foot of a wearer of an article of footwear.

The last according to an embodiment of the present disclosure may further comprise an incorporable last portion incorporated into a groove formed in the common portion or a space formed between the common portion and the movable portion.

In the last according to an embodiment of the present disclosure, the incorporable last portion may include a plurality of plate-shaped members extending widthwise of the article of footwear.

In the last according to an embodiment of the present disclosure, the incorporable last portion may include a rod-shaped member extending longitudinally of the article of footwear, and the plate-shaped member may have a through hole formed therein to pass the rod-shaped member therethrough.

In the last according to an embodiment of the present disclosure, the common portion may have a receiving hole formed therein to receive an end portion of the plate-shaped member.

The last according to an embodiment of the present disclosure may further comprise an incorporable last portion disposed in a gap formed between the movable portion and the common portion after the movable portion is positionally changed with respect to the common portion.

The last according to an embodiment of the present disclosure may further comprise a cover in the form of a sheet or a plate to externally cover at least a portion of the last or a gap formed in the last.

A method for manufacturing a last according to an embodiment of the present disclosure is a method for manufacturing a last for forming a footwear upper configuring an article of footwear. The method for manufacturing a last comprises the following steps. A first step is a step of preparing a last including a common portion invariable in shape and position, a movable portion invariable in shape and positionally variable with respect to the common portion, and a position adjustment mechanism that changes a position of the movable portion with respect to the common portion and fixes the movable portion in a predetermined position. A second step is a step of adjusting the position adjustment mechanism to change the position of the movable portion with respect to the common portion.

In the method for manufacturing a last according to an embodiment of the present disclosure, the second step of adjusting the position adjustment mechanism to change the position of the movable portion with respect to the common portion may include the steps of: generating a foot model for a user; generating from the foot model appropriate-position data indicating an appropriate position of the movable portion with respect to the common portion; and moving the movable portion to the appropriate position based on the appropriate-position data.

A method for manufacturing a footwear upper according to an embodiment of the present disclosure comprises the following steps. A first step is a step of covering the last of any one of the above aspects with an unformed upper made of a fiber sheet including a heat-shrinkable yarn. A second step is a step of applying heat to form the unformed upper along the shape of the last to be a formed upper.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A last for forming a footwear upper configuring an article of footwear, comprising:

a common portion invariable in shape and position;

a movable portion invariable in shape and positionally variable with respect to the common portion;

a position adjustment mechanism configured to change a position of the movable portion with respect to the common portion and fix the movable portion in a predetermined position; and an incorporable last portion incorporated into a groove formed in the common portion or a space formed between the common portion and the movable portion;

wherein the movable portion allows the last to have a middle foot portion positionally variable widthwise of the article of footwear;

wherein the incorporable last portion forms a portion corresponding to an instep of a foot of a wearer of the article of footwear; and wherein the incorporable last portion includes a plurality of plate-shaped members extending widthwise of the article of footwear.

2. The last according to claim 1, wherein the movable portion allows the last to have a middle foot portion positionally variable in level.

3. The last according to claim 1, wherein the movable portion allows the last to have a middle foot portion angularly variable with respect to the common portion.

4. The last according to claim 1, wherein the position adjustment mechanism has an engagement portion configured to switch between a first state in which the movable portion is fixed in a predetermined position and a second state in which the movable portion is movable.

5. The last according to claim 1, wherein a line along a boundary portion of the common portion and the movable portion is a straight or curved line corresponding to a line extending along a metatarsal bone of a foot of a wearer of the article of footwear.

6. The last according to claim 1, wherein the incorporable last portion includes a rod-shaped member extending longitudinally of the article of footwear, and the plurality of plate-shaped members have a through hole formed therein to pass the rod-shaped member therethrough.

7. The last according to claim 6, wherein the common portion has a receiving hole formed therein to receive an end portion of the rod-shaped member.

8. The last according to claim 1, further comprising:

a plate-like incorporable last portion disposed in a gap formed between the movable portion and the common portion after the movable portion is positionally changed with respect to the common portion.

9. The last according to claim 1, further comprising:

a cover in a form of a sheet or a plate to externally cover at least a portion of the last or a gap formed in the last.

* * * * *